US005549508A

United States Patent [19]

Searle et al.

[11] Patent Number: 5,549,508

[45] Date of Patent: Aug. 27, 1996

[54] SHARPENING LAWN MOWER BLADES

[75] Inventors: Leanne Searle, Campsea Ashe; Richard Astbury; Philip Eaves, both of Suffolk, all of Great Britain

[73] Assignee: Supreme Mowing Limited, South Yorkshire, United Kingdom

[21] Appl. No.: 409,302

[22] Filed: Mar. 24, 1995

[30] Foreign Application Priority Data

Mar. 25, 1994 [GB] United Kingdom ..... 9405926

[51] Int. Cl.[6] ..... B24B 3/00

[52] U.S. Cl. ..... 451/141; 451/403

[58] Field of Search ..... 491/741, 403, 491/438, 372

[56] References Cited

U.S. PATENT DOCUMENTS

| | | | |
|---|---|---|---|
| 2,879,629 | 3/1959 | Machovec | 451/141 |
| 3,688,451 | 9/1972 | Schnellmah et al. | 451/403 |
| 3,817,002 | 6/1974 | Cahsoh | 451/403 |
| 4,148,158 | 4/1979 | Hewitt | 451/141 |
| 4,192,103 | 3/1980 | Sousek | 51/249 |
| 4,694,613 | 9/1987 | Bernhard | 451/141 |

FOREIGN PATENT DOCUMENTS

| | | | |
|---|---|---|---|
| 0308053 | 3/1989 | European Pat. Off. . | |
| 0321391 | 6/1989 | European Pat. Off. . | |
| 3143575 | 11/1981 | Germany . | |
| 46011 | 11/1960 | United Kingdom | 451/141 |
| 2170740 | 8/1986 | United Kingdom . | |

*Primary Examiner*—Bruce M. Kisliuk
*Assistant Examiner*—Andrew Weinberg
*Attorney, Agent, or Firm*—Longacre & White

[57] ABSTRACT

Apparatus and a method for sharpening blades of a lawn mower cutting cylinder are disclosed. In the apparatus, a cutting cylinder is mounted on a fixed bed whereupon it can be subjected to the sharpening action of a grinding wheel passing along the length of its blades. The apparatus comprises urging means for resiliently urging the cylinder to rotate during the pass of the grinding wheel and to urge the blade against a support member. Additionally, indexing means is provided operable to rotate the cylinder about its axis to bring successive blades into position for sharpening by the grinding wheel.

5 Claims, 5 Drawing Sheets

SHARPENING LAWN MOWER BLADES

BACKGROUND TO THE INVENTION

1. Field of the Invention

This invention relates to sharpening lawn mower blades, more particularly to apparatus and methods for sharpening the blades of lawn mower cutting cylinders, such as upon manufacture and/or for maintenance purposes.

The term "lawn mower cutting cylinder" as used herein is to be understood as meaning a body comprising a plurality of generally coaxial, helical blades, angularly spaced about an axis, the cutting edge of each blade being radially outermost.

A lawn mower cutting cylinder is normally mounted as part of a lawn mower with its longitudinal axis (i.e. the shared longitudinal axis of the helical blades) horizontal in use, so that when the lawn mower is moved over a lawn with the cutting cylinder rotating about its axis, the blades co-operate with a fixed blade to cut off the tips of overlong blades of grass.

The quality of mowing achieved by the lawn mower depends in no small measure upon the sharpness of the blades of the cutting cylinder. If the blades are too blunt it will be impossible to mow the lawn evenly, since some blades of grass will not be cut at all, while other blades of grass will be torn rather than cut, or even uprooted entirely from the soil. An attractively mowed lawn will therefore not be achieved.

SUMMARY OF THE PRIOR ART

One known method of sharpening the blades of a lawn mower cutting cylinder is to mount the cutting cylinder on a fixed bed such that the cutting cylinder may be rotated about its longitudinal axis. Displaced a short distance from the fixed bed is a sliding bed, which is capable of being moved, using a motor, in the plane of the sliding bed in any direction substantially parallel to or perpendicular to the axis of the cutting cylinder. A grinding wheel, rotatable by means of an electric motor, is mounted on the sliding bed with its axis of rotation substantially parallel to the axis of the cutting cylinder.

The blades are be sharpened by the following procedure. An operator aligns the sliding bed so that the grinding wheel is proximate a first end of the cutting cylinder, and rotates the cylinder to bring an end portion of a first blade into angular register with the grinding wheel. With the grinding wheel turning at high speed, the sliding bed is then slid in its plane towards the grinding wheel in a direction substantially perpendicular to the axis of the cutting cylinder—hereinafter referred to as a "second direction"—to bring a peripheral grinding edge of the grinding wheel into contact with the end portion of the first blade. In this position the peripheral grinding edge of the grinding wheel grinds a relief angle on the cutting edge of the first blade, thus sharpening it.

Proximate the grinding wheel is provided a support member which abuts the blade during the sharpening procedure such as to prevent the blade from moving away from the grinding wheel by rotation of the cutting cylinder about its axis. The operator then slides the sliding bed in its plane in a direction substantially parallel to the longitudinal axis the cutting cylinder—hereinafter referred to as a "first direction"—and simultaneously rotates the cutting cylinder about its axis so that at every instant during the sliding movement in the first direction the portion of the blade which is in longitudinal register with the grinding wheel (i.e. at the same distance along the longitudinal axis of the cylinder as the grinding wheel is) is also in angular register therewith. Simultaneously with this sliding movement of the sliding bed, the operator applies a force to the cylinder to urge the first blade against the support member, in order to reduce vibration and thus ensure evenness of the grinding of the cutting edge. In this way, the entire length of the cutting edge of the first blade is sharpened.

Once this is done, the operator separates the cutting cylinder from the grinding wheel by sliding the sliding bed a short distance in a direction opposite to the second direction, then sliding the sliding bed in a direction opposite to the first direction so as to return the first end of the cutting cylinder to a position proximate the grinding wheel, and, finally, rotating the cutting cylinder about its longitudinal axis so as to bring an end portion of a second blade of the cutting cylinder into angular register with the grinding wheel. This final step is known as "indexing". The grinding cycle as described above is repeated, each time using a different blade of the cutting cylinder, until all the blades are sharpened.

This method of sharpening the blades of a lawn mower cutting cylinder suffers from several disadvantages.

Very significantly, it is highly labour intensive, and the operator must be highly skilled to guide each blade correctly past the grinding wheel.

Furthermore, taking into account the sharpness of the cutting blades and the typical speeds which the grinding wheel rotates, the above described known procedure is potentially very hazardous to the operator, who holds the lawn mower cutting cylinder and manually controls the sharpening procedure.

SUMMARY OF THE INVENTION

The present invention seeks to ameliorate the above problems and to provide a cutting blade sharpening process, and an apparatus therefor, which has improved efficiency and is safer.

Accordingly, in a first aspect, the invention provides apparatus for sharpening a blade of a lawn mower cutting cylinder, comprising:

a sliding bed movable in a first direction;

a grinding wheel mounted on said sliding bed;

means for rotatably mounting a lawn mover cutting cylinder adjacent said sliding bed with its longitudinal axis substantially parallel to the said first direction;

at least one support member for maintaining a grinding portion of a blade of the cutting cylinder, which is in longitudinal register with said grinding wheel, in angular register wherewith, so that said grinding wheel contacts said grinding portion for sharpening same upon rotation of said grinding wheel;

displacement means for moving said sliding bed in said first direction, whereby said grinding wheel sharpens the blade along its length at a said grinding portion thereof which travels along it during said sliding movement in the first direction; and urging means for resiliently urging the cutting cylinder to rotate such as to urge said blade against said at least one support member.

The resilient urging means dampens vibrations of the grinding wheel and cutting cylinder during the grinding process, and so reduces wear of the apparatus. It also improves the evenness and accuracy of the sharpening.

In a second aspect, the invention provides apparatus for sharpening the blades of a lawn mower cutting cylinder, comprising:

a sliding bed movable in a first direction;

a grinding wheel mounted on said sliding bed;

means for rotatably mounting the lawn mower cutting cylinder adjacent said sliding bed with its longitudinal axis substantially parallel to the said first direction;

at least one support member for maintaining a grinding portion of a first blade of the cutting cylinder, which is in longitudinal register with said grinding wheel, in angular register therewith, so that said grinding wheel contacts said grinding portion of the first blade for sharpening same upon rotation of said grinding wheel;

displacement means for moving said sliding bed in said first direction, whereby said grinding wheel sharpens the first blade along its length at a said grinding portion thereof which travels along it during said sliding movement in the first direction; and indexing means operable to rotate said cutting cylinder about its longitudinal axis so as to bring a grinding portion of a second blade of the cutting cylinder into register with said grinding wheel ready for sharpening the second blade.

Preferably, the indexing means comprises an indexing member mounted on the sliding bed and configuring means for configuring said indexing member;

the configuring means being operable to configure said indexing member into an indexing position in which upon movement of said sliding bed in the first direction, or a direction opposite thereto, the indexing member engages a third blade of the cutting cylinder, or optionally the first blade or the second blade, and rotates the cutting cylinder about its longitudinal axis so as to bring the grinding portion of the second blade into register with the grinding wheel ready for sharpening the second blade;

the configuring means being further operable to configure said indexing member into a retracted position in which the indexing member can be brought into angular and longitudinal register with any of said blades without engaging it;

whereby when the indexing member is configured in its indexing position, the cylinder is indexable by sliding movement of the sliding bed in the first direction or a direction opposite thereto, and whereby when the indexing member is configured in its retracted position, the cylinder can be returned to an unindexed configuration by sliding movement of the sliding bed in a direction opposite to that by which the cylinder is indexed.

In a third aspect, the invention provides indexing means for use in the apparatus defined above according to the second aspect of the invention.

In a fourth aspect, the invention provides a method of sharpening a blade of a lawn mower cutting cylinder, comprising the steps (1) providing an apparatus according to the first aspect of the invention;

(2) contacting said grinding wheel with the grinding portion of the blade of the cutting cylinder;

(3) sliding the sliding bed in the said first direction to move said grinding wheel along the blade, thereby sharpening it along its length; and (4) optionally repeating steps (2) and (3) using a different blade of the cutting cylinder.

In a fifth aspect, the invention provides a method of sharpening the blades of a lawn mower cutting cylinder, comprising the steps of:

(1) providing an apparatus according to the second aspect of the invention;

(2) contacting said grinding wheel with the grinding portion of a first blade of the cutting cylinder;

(3) sliding the sliding bed in the said first direction to move said grinding wheel along the first blade, thereby sharpening it along its length;

(4) rotating said cutting cylinder by use of said indexing means so as to bring said grinding portion of said second blade of the cutting cylinder into register with said grinding wheel ready for sharpening said second blade; and (5) optionally repeating steps (2) to (4) using the second or a third blade of the cutting cylinder in place of said first blade and a third or a fourth blade, respectively, of the cutting cylinder in place of said second blade.

It is to be appreciated that within the scope of the invention, in all its aspects, are variations in which the grinding head is fixed, and it is the lawn mower cutting cylinder which is mounted on a slidable bed.

DETAILED DESCRIPTION OF A PREFERRED EMBODIMENT

An embodiment of the various aspects of the invention will now be described in detail, by way of example, with reference to the accompanying drawings.

Figure 1:
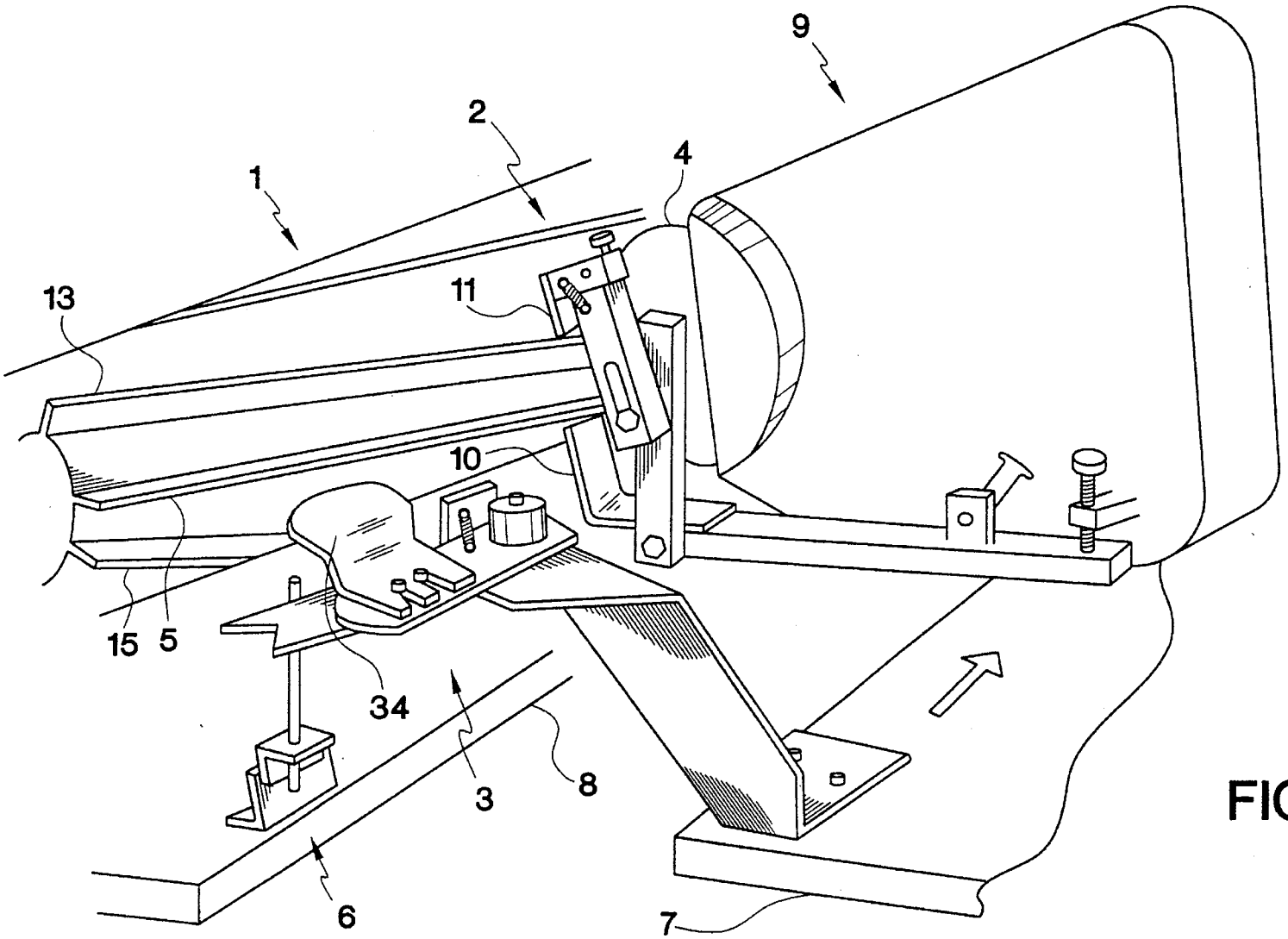
FIG. 1 is a perspective view of apparatus for sharpening blades of a lawn mower cutting cylinder according to the invention in use.

Referring first to FIG. 1, an apparatus according to the invention is shown being used to sharpen a first blade 5 of a lawn mower cutting cylinder 1, each blade of which is in the shape of a right-handed helix. A grinding wheel 4 rotates in a plane, which is normal to the longitudinal axle of the cylinder 1, and thereby sharpens a grinding portion of the first blade 5.

The cylinder 1 is mounted on a fixed bed 8, and is rotatable about its longitudinal axis. The housing 9 of the grinding wheel 4 is mounted on a sliding bed 7, and is slidable in a first direction from left to right of the figure (as marked by the arrow), or in the opposite direction, sufficiently far that the grinding wheel 4 can sweep out the entire length of the cylinder. A motor (not shown) is provided for moving the sliding bed in the first direction, and in the opposite direction, at a rate of, e.g. about 5 cm/s.

At the stage of the grinding cycle illustrated in FIG. 1, the sliding bed 7 is sliding in the first direction, and as it does so the grinding portion of the first blade 5 (i.e. the portion in contact with the grinding wheel 4) changes. A bottom finger 10, which is mounted on the housing 9 of the grinding wheel 4, supports the first blade 5, and thus rotates the cylinder anti-clockwise (as seen in this diagram) keeping the grinding portion of the first blade 5 in angular register with the grinding wheel 4. At the same time, a top finger 11 urges downwards a second blade 13 of the cylinder which is angularly spaced from the first blade in an anti-clockwise direction, thus pressing the blade 5 against the support finger 10.

Also mounted on the sliding bed 7 is an indexing apparatus 3, the indexing finger 34 of which is in a slot defined between the first blade 5 and a third blade 15 which is angularly spaced therefrom in a clockwise direction. While the cylinder is rotating under the action of the support finger 10, the indexing finger remains at the same distance from each of these blades 5, 15.

When the sliding bed 7 has slid sufficiently far in the first direction, the grinding wheel 4 and the support finger 10 pass the end of the cylinder 1, so the cutting cylinder stops being turned. However, a rod 46 projecting upwardly from a configuring apparatus 6 engages a guide plate 58 of the indexing apparatus 3 and pivots the indexing finger 34 away from the cylinder 1, so that the indexing finger 34 does not engage the first blade 5.

As the sliding bed continues to slide, the indexing apparatus 3 moves past the configuring device 6, so the indexing finger 34 is pivoted back towards the cylinder by force applied a spring 42 included in the indexing device 3. Thus the indexing finger 34 enters the slot defined between the first blade 5 and the second blade 13.

Eventually, the sliding bed 7 reaches a stop, at which point it reverses direction (i.e. begins moving towards the left, as seen in FIG. 1). As the sliding bed 7 moves in this direction, the indexing apparatus 3 again engages the rod 46 of the configuring device, but this time the rod 46 pivots into a non-vertical configuration to allow the indexing apparatus 3 to pass. The indexing finger thus is not deflected away from the cylinder, and instead engages the upper surface of the first blade 5, and begins to rotate the cylinder anti-clockwise. By the time the grinding head and support finger 10 reach the right end of the cylinder 1, the cylinder 1 has been indexed sufficiently that it is the second blade 13 which is contacted by the grinding wheel 4.

As the sliding bed 7 continues to move towards the left, the grinding wheel 4 sharpens the second blade 13, which remains in angular register with the grinding wheel 4 due to rotation of the cylinder. Eventually another stop is reached, at which point the sliding bed changes direction once more, and begins to move along the cylinder to the right, until a situation is reached identical to that shown in FIG. 1 but with the cylinder 1 rotated clockwise to the extent that the second blade 13 has taken the place of the first blade 5.

The sliding bed of this embodiment is also adapted to be movable in a second direction, towards the cylinder, and in the opposite direction. This allows the grinding wheel to be brought into contact with the lawn mower, even if, for example, the radius of the grinding wheel has been reduced by wear during the grinding process.

Figure 2:
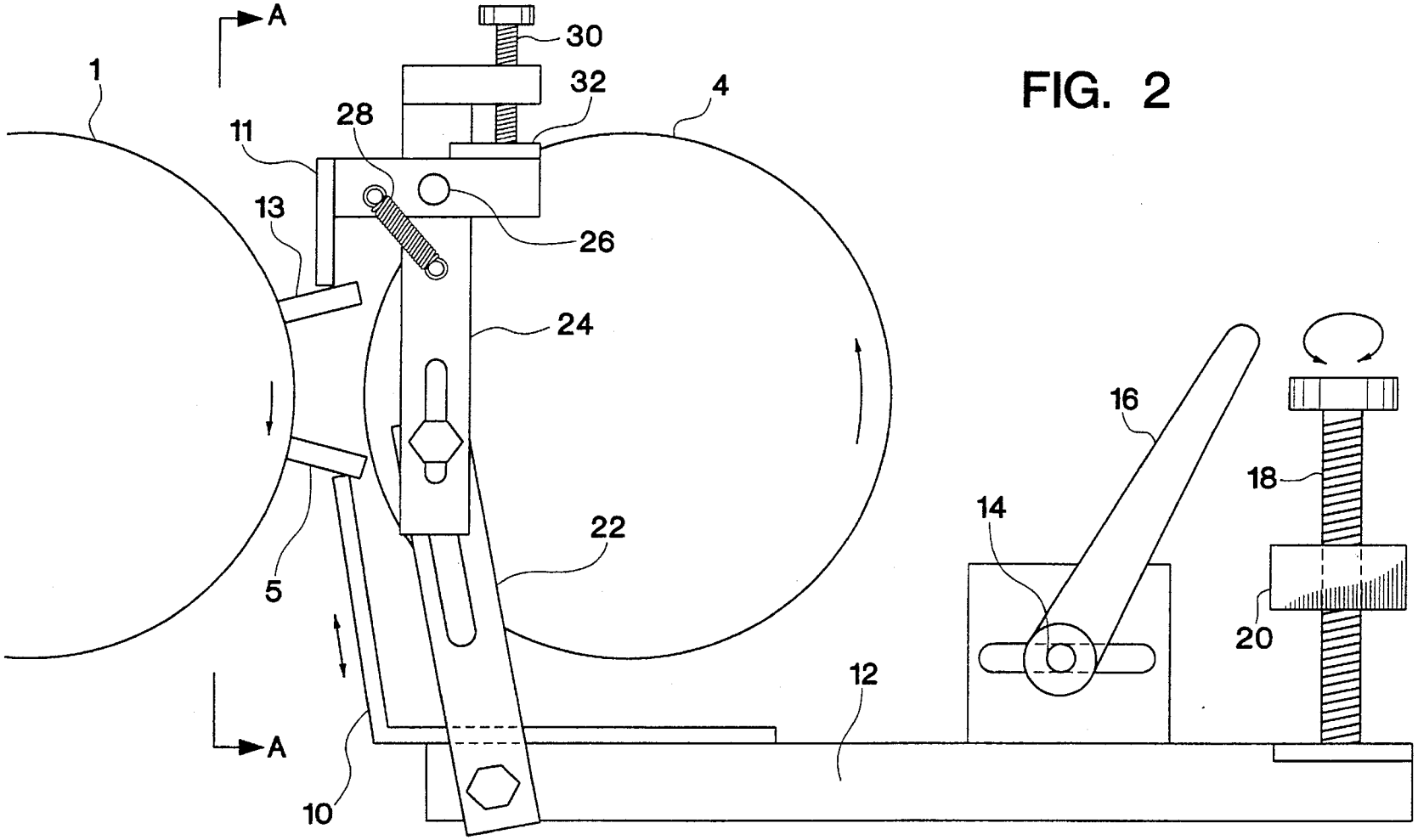
FIG. 2 is a cross-sectional view of part of the apparatus of FIG. 1.

The apparatus for guiding the blades of the cylinder is shown more clearly in FIG. 2. The support finger 10 is mounted on a clamping arm 12, and thus the position of the support finger 10 can be adjusted by pivoting the clamping arm 12 (as viewed in FIG. 2) about a pivot 14. Clockwise rotation of the clamping arm 12 can be caused by rotation of an adjustment screw 18 within a screw threaded sleeve 20 mounted on the housing 9. A locking handle 16 is operable to fix the orientation of the support arm 12 about the pivot 14, so as retain the support finger 10 in the desired position, that is supporting the blade 5 while it is ground by the grinding wheel 4.

Also mounted on the support arm 12 is a first support bracket 22 on the upper end of which is adjustably mounted a second support bracket 24. On the upper end of the second support bracket 24 is provided a top finger 11 which is pivotable about pivot 26 on the upper support bracket 24. A stop 32, the position of which is adjustable by rotation of stop screw 30, limits the range of positions of the top finger 11. A spring 28 urges the finger 11 to rotate anti-clockwise.

Because the configuration of the support finger 10 and the top finger 11 are adjustable so easily, the embodiment is suitable for use with cutting cylinders having different dimensions, for example, different diameters or different angular intervals between the blades.

In FIG. 2, the support finger 10 is shown having been adjusted by use of the adjustment screw 18, so as to be positioned below the first blade 5 of a cutting cylinder 1. The top finger 11 has been adjusted so as to lie above the second blade 13 of the cylinder 1, urging it downwards due to force applied by the spring 28. The pressure applied by the top finger 11 to the second blade 13 can be adjusted using the stop screw 30.

Figure 3:
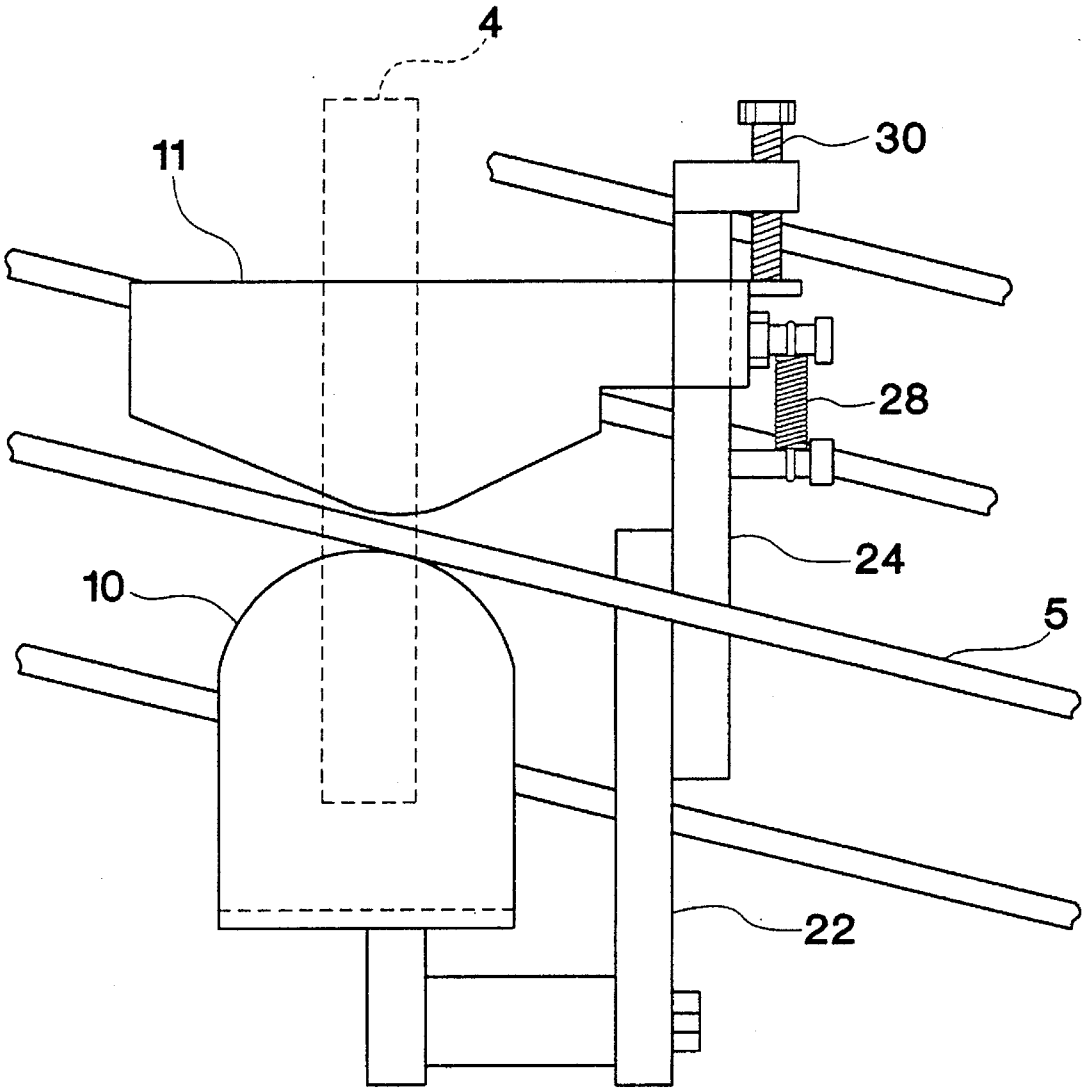
FIG. 3 is another view of part of the apparatus of FIG. 1.

FIG. 3 is another view of this part of the apparatus seen looking along the direction A—A marked on FIG. 2. In this case, the top finger 11 has been arranged so as to apply downward pressure to the first blade 5, as it is ground by the grinding wheel 4.

Each of the top finger 11 and the support finger 10 are contoured in the plane of the diagram to facilitate the introduction between them of a new blade once the cutting cylinder has been indexed.

Figure 4:
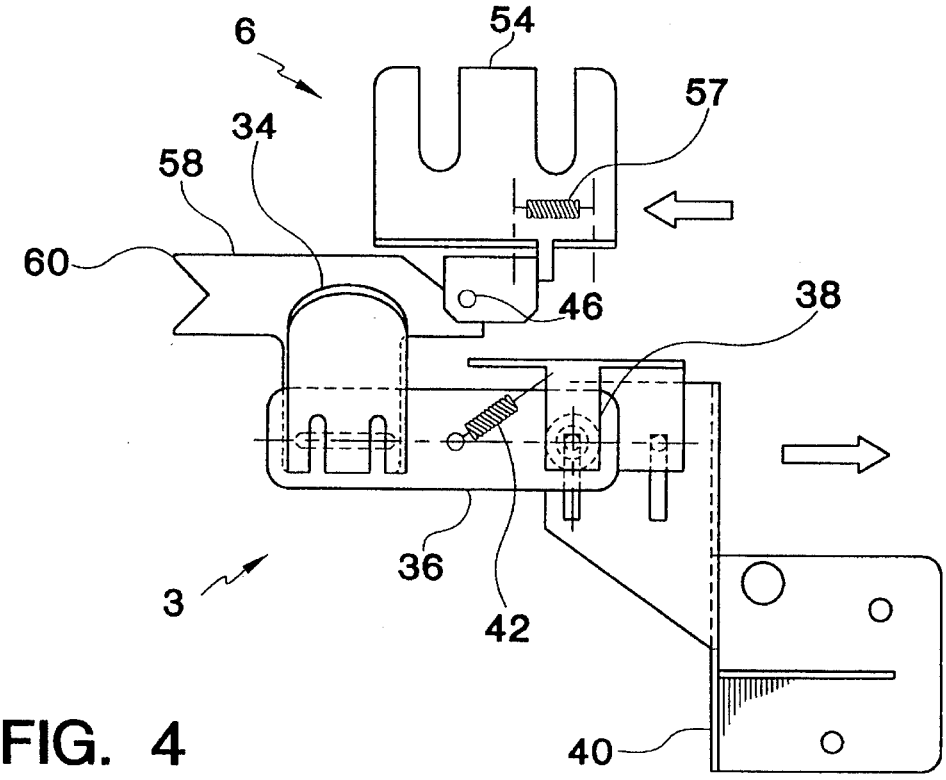
FIG. 4 is a top view of the indexing means and configuring means of FIG. 1.
Figure 5:
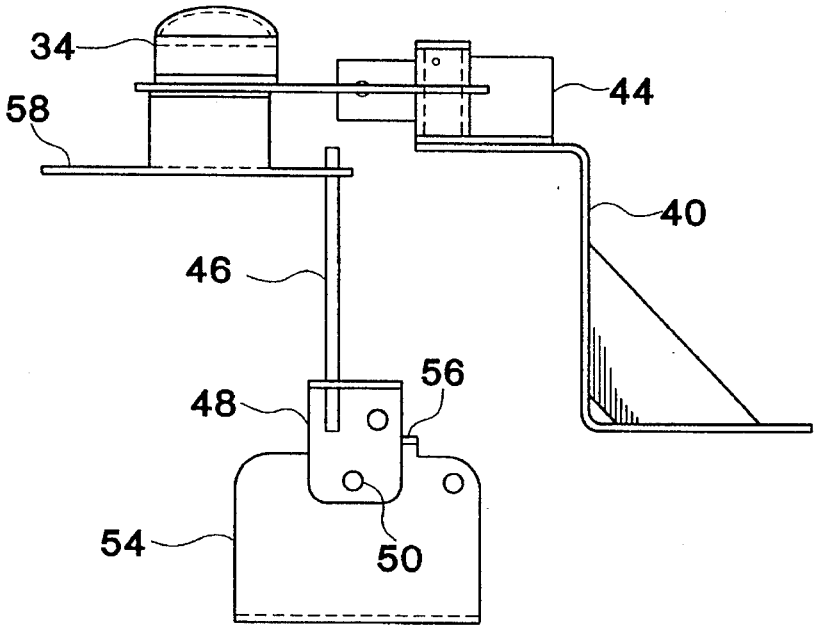
FIG. 5 is another view of the indexing means and configuring means of FIG. 1.
Figure 6:
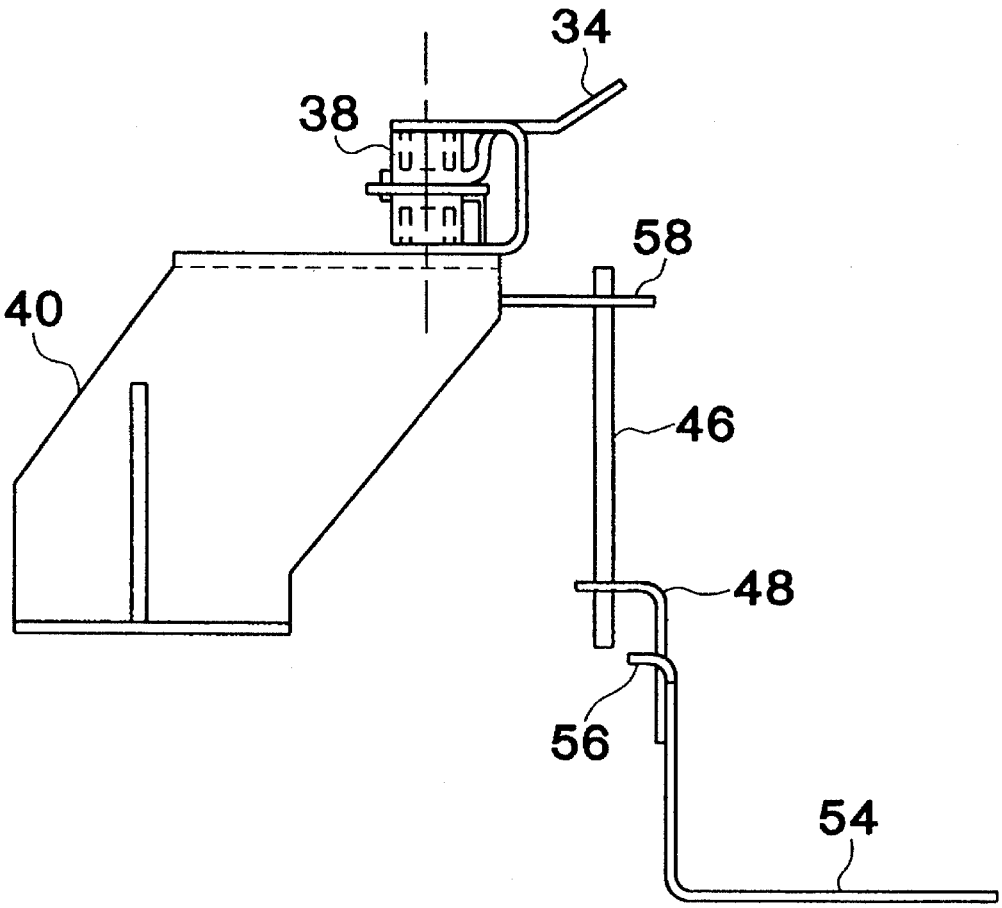
FIG. 6 is another view of the indexing means and configuring means of FIG. 1.

Turning now to FIGS. 4 to 6, the indexing apparatus 3 is shown comprising an indexing finger 34 which is mounted on a support plate 36. The support plate 36 is pivotably mounted using a pivot 38 on a mounting arm 40 which is itself mounted on the sliding bed 7. A spring 42 connects the support plate 36 to a projection 44 of the mounting arm 40 and resiliently urges the indexing finger 36 rotate clockwise (as seen in FIG. 4) towards the cylinder 1 (not shown).

The configuring apparatus 6 comprises a rod 46 mounted on a first configuring bracket 48. This first configuring bracket 48 is pivotable in its plane about a pivot 50 on a second configuring bracket 54, which is mounted on the fixed bed 8. The rod 46 is resiliently maintained in an upstanding configuration by a spring 52 which connects the first and second configuring brackets 48, 54. A projection 56 of the support bracket 54 acts as a stop on the movement of the pivoting bracket 48, so that the rod 46 cannot be rotated in a clockwise direction (as viewed in FIG. 5) from its vertical position.

As the sliding bed 7 slides in the first direction (indicated by the arrow on FIG. 4), an upper portion of the rod 46 engages a guide plate 58 connected to the support plane 36 and forces the support plate 36 to rotate anti-clockwise (as viewed in FIG. 4), thus moving the support finger 34 away from the cylinder 1. Note that the rod 46 is prevented from being swung out of its vertical configuration at this stage by the projection 56 of the second configuring bracket 54, which limits the range of possible configurations of the first configuring bracket 48. When the rod 46 has passed the tip 60 of the guide plate 58, the support plate swings back clockwise towards the cylinder due to the resilience of the spring 42.

When the motion of the sliding bed 7 is in the opposite direction, as described above, the upper portion of the rod 46 enters the V-shaped cut-away portion of the guide plate 58, and when it engages the guide plate 58 it is swung back anti-clockwise (as viewed in the direction shown on FIG. 5), and thus passes under the guide plate 58. Once the indexing apparatus 3 has passed, the rod 46 is returned to its vertical configuration by a spring 57 connecting the first and second configuring brackets.

This embodiment has been described above for the sake of example only, and many variations are possible, as will be clear to one skilled in the art. For example, the grinding wheel and indexing apparatus may be mounted on the sliding bed, and the indexing device on the fixed bed. It is also to be appreciated that the embodiment described above, and as depicted in FIGS. 1 to 6, has to be adapted for sharpening the blades of cutting cylinders in which the blades are shaped as left-handed helices, the adaptation being straightforward for one skilled in the art.

We claim:

1. Apparatus for sharpening a blade of a lawn mower cutting cylinder, comprising:

a sliding bed movable in a first direction;

a grinding wheel mounted on said sliding bed;

means for rotatably mounting a lawn mover cutting cylinder adjacent said sliding bed with its longitudinal axis substantially parallel to the said first direction;

at least one support member for maintaining a grinding portion of a blade of the cutting cylinder, which is in longitudinal register with said grinding wheel, in angular register therewith, so that said grinding wheel contacts said grinding portion for sharpening same upon rotation of said grinding wheel, said at least one support member comprising a support finger disposed to contact the blade being acted upon by the grinding wheel;

displacement means for moving said sliding bed in said first direction, whereby said grinding wheel sharpens the blade along its length at a said grinding portion thereof which travels along it during said sliding movement in the first direction; and urging means for resiliently urging the cutting cylinder to rotate such as to urge said blade against said at least one support member, said urging means comprising a resilient finger disposed to act on a blade of the cutting cylinder;

wherein the support finger and the resilient finger act on adjacent blades of the cutting cylinder.

2. A method of sharpening a blade of a lawn mower cutting cylinder in an apparatus according to claim 1, comprising the steps of:

(1) contacting said grinding wheel with the grinding portion of the blade of the cutting cylinder;

(2) sliding the sliding bed in the said first direction to move said grinding wheel along the blade, thereby sharpening it along its length; and (4) optionally repeating steps (2) and (3) using a different blade of the cutting cylinder.

3. The apparatus according to claim 1, wherein said urging means comprises a spring acting on said resilient finger to urge said resilient finger toward said blade of the cutting cylinder.

4. Apparatus for sharpening the blades of a lawn mower cutting cylinder, comprising:

a sliding bed movable in a first direction;

a grinding wheel mounted on said sliding bed;

means for rotatably mounting a lawn mover cutting cylinder adjacent said sliding bed with its longitudinal axis substantially parallel to the said first direction;

at least one support member for maintaining a grinding portion of a first blade of the cutting cylinder, which is in longitudinal register with said grinding wheel, in angular register therewith, so that said grinding wheel contacts said grinding portion of the first blade for sharpening same upon rotation of said grinding wheel;

displacement means for moving said sliding bed in said first direction, whereby said grinding wheel sharpens the first blade along its length at a said grinding portion thereof which travels along it during said sliding movement in the first direction; and indexing means operable to rotate said cutting cylinder about it longitudinal axis so as to bring a grinding portion of a second blade of the cutting cylinder into register with said grinding wheel ready for sharpening the second blade;

wherein the indexing means comprises an indexing member mounted on the sliding bed and adjustment means for adjusting said indexing member;

the adjustment means being operable to configure said indexing member into an indexing position in which upon movement of said sliding bed in the first direction, or a direction opposite thereto, the indexing member engages a third blade of the cutting cylinder, or optionally the first blade or the second blade, and optionally the first blade or the second blade, and rotates the cutting cylinder about its longitudinal axis so as to bring the grinding portion of the second blade into register with the grinding wheel ready for sharpening the second blade;

the adjustment means being further operable to configure said indexing member into a retracted position in which the indexing member can be brought into angular and longitudinal register with any of said blades without engaging it;

whereby when the indexing member is configured in its indexing position, the cylinder is indexable by sliding movement of the sliding bed in the first direction or a direction opposite thereof, and whereby when the indexing member is configured in its retracted position, the cylinder can be returned to an unindexed configuration by sliding movement of the sliding bed in a direction opposite to that by which the cylinder is indexed.

5. A method of sharpening blades of a lawn mower cutting cylinder in apparatus according to claim 4, comprising the steps of:

(1) contacting said grinding wheel with the grinding portion of a first blade of the cutting cylinder;

(2) sliding the sliding bed in the said first direction to move said grinding wheel along the first blade, thereby sharpening it along its length;

(3) rotating said cutting cylinder by use of said indexing means so as to bring said grinding portion of said second blade of the cutting cylinder into register with said grinding wheel ready for sharpening said second blade; and (4) optionally repeating steps (2) to (4) using the second or a third blade of the cutting cylinder in place of said first blade and a third or a fourth blade, respectively, of the cutting cylinder in place of maid second blade.

* * * * *